US007536948B1

(12) United States Patent
Cockrum

(10) Patent No.: US 7,536,948 B1
(45) Date of Patent: May 26, 2009

(54) CAN CRUSHING DEVICE

(76) Inventor: Raleigh L. Cockrum, 5712 Greenview Rd., Oakwood Hills, IL (US) 60013

( * ) Notice: Subject to any disclaimer, the term of this patent is extended or adjusted under 35 U.S.C. 154(b) by 0 days.

(21) Appl. No.: 12/025,101

(22) Filed: Feb. 4, 2008

(51) Int. Cl.
*B30B 9/32* (2006.01)
*B30B 1/26* (2006.01)

(52) U.S. Cl. ..... 100/45; 100/98 R; 100/215; 100/216; 100/218; 100/266; 100/282; 100/295; 100/902

(58) Field of Classification Search ..... 100/45, 100/99, 98 R, 215, 216, 218, 245, 266, 282, 100/295, 902
See application file for complete search history.

(56) References Cited

U.S. PATENT DOCUMENTS 2,773,536 A 12/1956 Lange
2,958,273 A * 11/1960 Morrow ..... 100/98 R
3,667,386 A 6/1972 Workman
3,732,804 A 5/1973 Moller
3,777,659 A 12/1973 McCarten
3,907,087 A 9/1975 Tanaka
3,916,780 A * 11/1975 Heiser ..... 100/49
3,988,978 A 11/1976 Flick
4,291,618 A * 9/1981 Heiser et al. ..... 100/35
4,292,891 A 10/1981 Shelley
4,333,397 A 6/1982 Modes
4,358,994 A 11/1982 Talley
4,369,699 A 1/1983 Dailey
4,383,480 A 5/1983 Jerden
4,474,108 A 10/1984 Lonze
4,561,350 A 12/1985 Snoe et al.
4,561,351 A 12/1985 Ader
4,601,238 A 7/1986 Davis, Jr. et al.
4,653,398 A 3/1987 Fowler
4,669,374 A 6/1987 Davis, Jr. et al.
4,884,502 A 12/1989 Stacey, Jr.
5,121,685 A * 6/1992 Turner ..... 100/49
5,251,546 A * 10/1993 Wergeland et al. ..... 100/346
5,327,822 A * 7/1994 Koenig ..... 100/45
5,456,166 A * 10/1995 Belongia et al. ..... 100/351

* cited by examiner

*Primary Examiner*—Jimmy T Nguyen
(74) *Attorney, Agent, or Firm*—Mathew R. P. Perrone, Jr.; Brie A. Crawford

(57) ABSTRACT

A can crushing device, which crushes the can along its cylindrical axis, supports the can on a can platform, dents the side of the can and flattens the can. A can chute or feed hopper feeds cans to the crush chamber, while various collection devices receive the crushed cans.

10 Claims, 23 Drawing Sheets

CAN CRUSHING DEVICE

BACKGROUND OF THE INVENTION

Recycling aluminum cans provides a very efficient use of many resources. Typically, cans to be recycled are gathered in a certain place. The crushed cans are then transported to a place, where the metal (usually aluminum) therein may be reused, reprocessed, or further transported. The metal is usually reshaped into cans, much less expensively, than the cost of forming cans starting with a metal ore.

To facilitate transportation of the cans, it is very much preferred to crush the cans other or otherwise reduce the volume of cans or other material being transported. Some can crushers operate to crush the can substantially perpendicularly to its cylindrical axis. However, cans crushed in this fashion are harder to transport, especially since such cans are difficult to form into bales.

With a purpose of transporting the cans in bales, crushing along the cylindrical axis makes forming a bale of the cans tremendously more efficient. Yet the devices to crush in that fashion tend to be more complicated and harder to use. Still it is necessary to achieve the desired amount of crushing, in order to make transporting of the crushed cans in bales more efficient.

Among the can crushers available, it is required to open the prior art crusher, drop in the can, close the crusher, activate the crusher, reopen the crusher and remove the can. Then, the can or container is not crushed as small as possible. It is very desirable crush the can more efficiently and leave it smaller, while recovering it more efficiently.

These features are especially contradictory with the crushing of the can along its cylindrical axis. The sturdiness of the can is necessary for strength and use of the can, can interfere greatly with efficient recycling thereof. Yet, the crushing of the can along its cylindrical axis is very desirable.

A device directed to the solution of these problems can provide great advantages relative to the prior art. Such a more efficient device can have a major, positive on the environment.

SUMMARY OF THE INVENTION

Among the many objectives of the present invention is the provision of a can crushing device, which can efficiently crush the can along the longitudinal or cylindrical axis of the can.

Another objective of the present invention is the provision of a can crushing device, in which the crushed can is capable of being included in a bale of cans.

Also, an objective of the present invention is the provision of a can crushing device, which can crush the can to a reduced volume.

Moreover, an objective of the present invention is the provision of a can crushing device which repeatedly crushes a series of cans.

A further objective of the present invention is the provision of a can crushing device, which can eliminate a repeated opening and closing of the crushing device.

A still further objective of the present invention is the provision of a can crushing device, which has a feeding mechanism to direct the cans to the crushing device.

Yet a further objective of the present invention is the provision of a can crushing device, which can senses the activation of the crushing mechanism.

These and other objectives of the invention (which other objectives become clear by consideration of the specification, claims and drawings as a whole) are met by providing a can crushing device which crushes the can along its cylindrical axis.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

The can crushing device has a crushing assembly fed by a can chute or feed hopper. The crushing assembly communicates with a crush chamber assembly as does the feed hopper. The crush chamber assembly includes a can platform supports the can to be crushed during crushing process and permits the crushed can to leave the platform. A ram from the crushing assembly of the can crushing device slides over the can platform, into the crushing chamber and flattens the can against the rear wall of the crushing chamber.

Also as the ram approaches the can, a rod extends therefrom and makes a dent in the side of the can. As the ram contacts the can and causes a dent therein, the dent facilitates crushing of the can along its cylindrical axis and permits more efficient crushing, and provides for the top and the bottom of the can to be on the same side of the can as the can is crushed. The crushed then may pass through a travel slot in the can platform and into a desired container. With the can flattened along its cylindrical axis, a group of the cans, so flattened, can be formed easily into a bale for transport.

Figure 1:
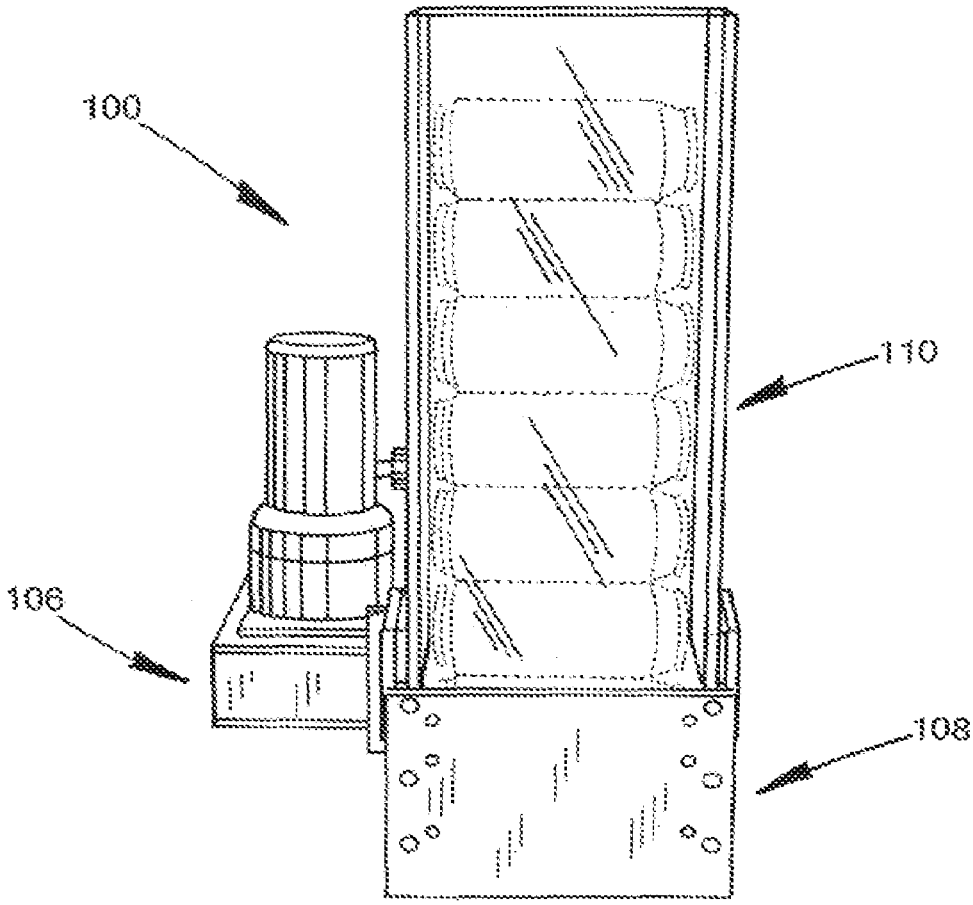
FIG. 1 depicts a front view of can crushing device 100.
Figure 2:
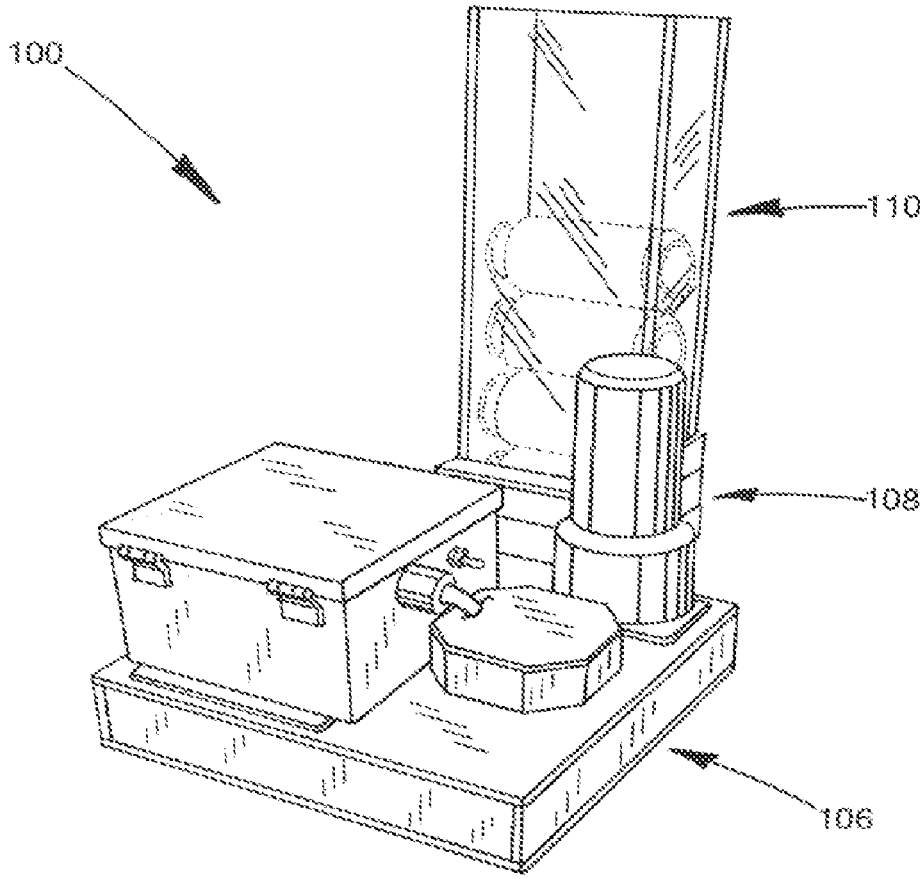
FIG. 2 depicts a rear perspective view of can crushing device 100 of this invention.
Figure 3:
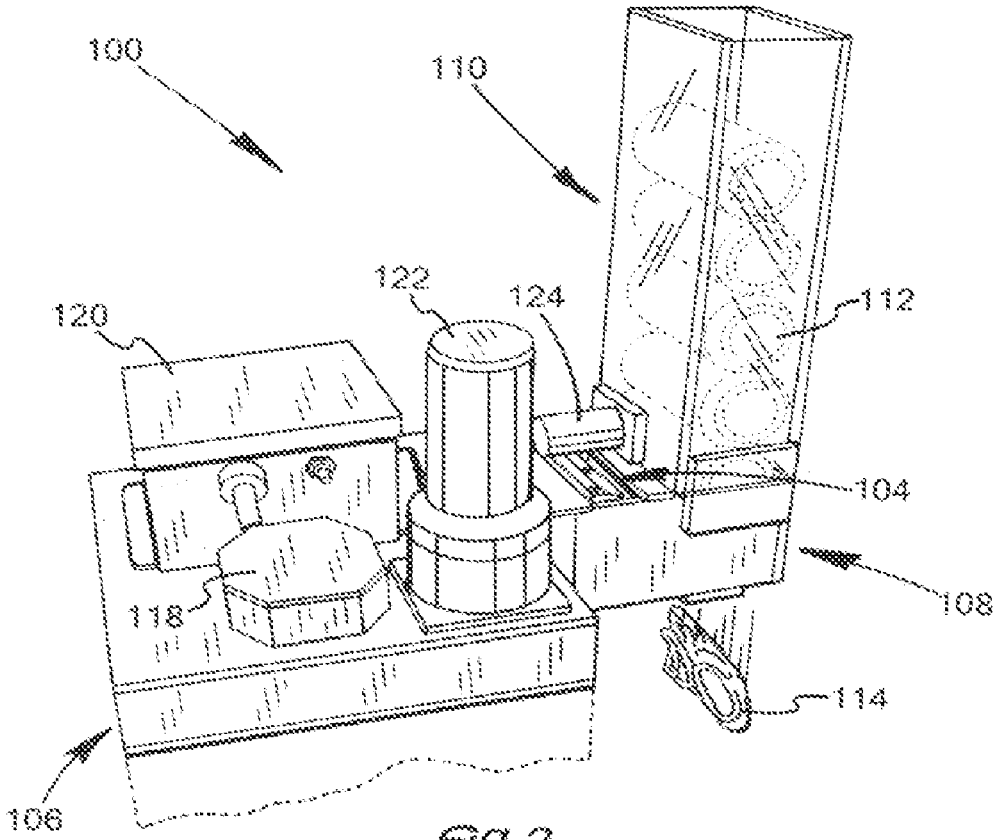
FIG. 3 depicts a side perspective view of can crushing device 100 of this invention.

Turning now to FIG. 1, FIG. 2, and FIG. 3, the can crushing device or can crusher 100 includes a plunger or ram assembly 104, a crankcase assembly 106, a crush chamber assembly 108, and a feed hopper assembly 110, which work together to flatten beverage can 112 along its cylindrical height and form flat or crushed can 114. Feed hopper assembly 110 permits a repetitive flattening of a plurality of can 112 into a series of crushed can 114.

The crankcase assembly 106 drives the plunger assembly 104 into the crush chamber assembly 108. An electric circuit box 120 has a gear box 118 between it and an electric motor 122. Gear box 118 is powered by the electric motor 122 and is connected to crankcase assembly 106. The presence of can 112 at a proper point in feed hopper assembly 110 trips a sensor 124 and activates the electric motor 112 and hence the plunger assembly 104 of the crush chamber assembly 108. As the crushed can 114 drops out of the feed hopper assembly 110, another can 112 drops into the crush chamber assembly 108 to repeat the process.

Figure 4:
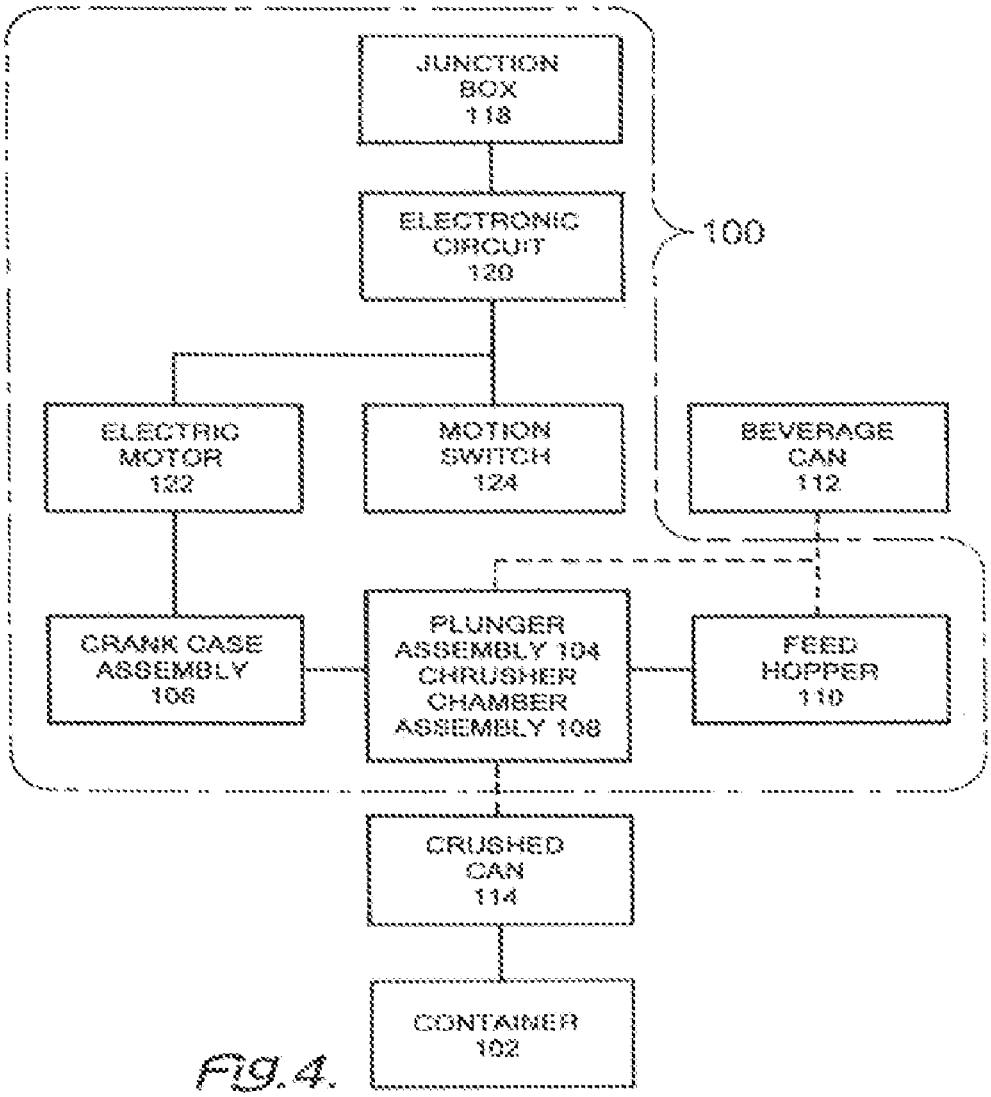
FIG. 4 depicts a block diagram of can crushing device 100.

Turning now to FIG. 4, the can crusher assembly 100 includes a ram or plunger assembly 104, which communicates with the crusher chamber assembly 108. Also communicating with the crusher chamber assembly 108, is the feed hopper assembly 110. Connected to the plunger assembly 104 is the crankcase assembly 106. Crankcase assembly 106 is powered by electric motor 122. In a preferred form, motion switch 124 activates electric motor 122 through its connection with electric circuit box 120. Junction box 118 provides power to the electronic circuit 120. In this fashion, beverage can 112 becomes crushed can 114.

As crushed can 114 falls into container 102, container 102 may be any suitable device. Container 102 may store the crushed cans 114, may be used to transport the crushed cans 114, may package the crushed cans 114, for example into a bale, or take other appropriate actions.

Figure 5:
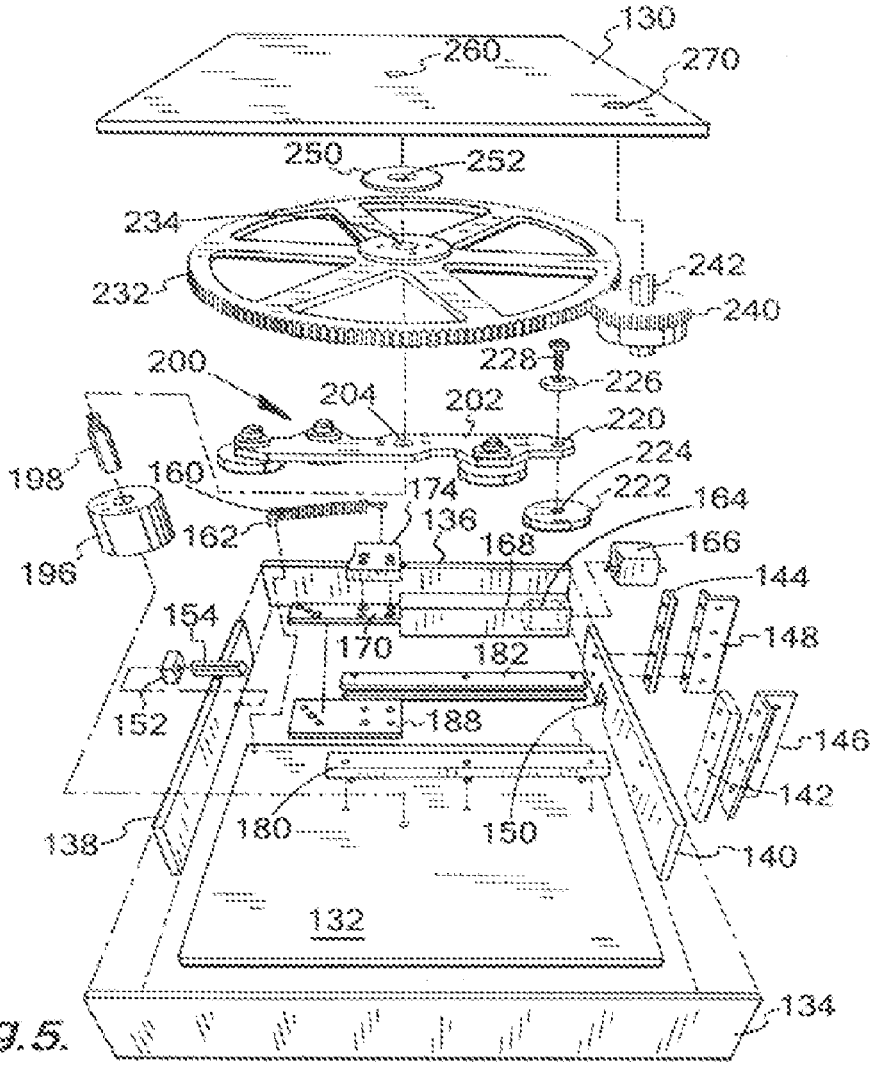
FIG. 5 depicts an exploded perspective view of crank case assembly 106 for can crushing device 100 based on FIG. 2.
Figure 7:
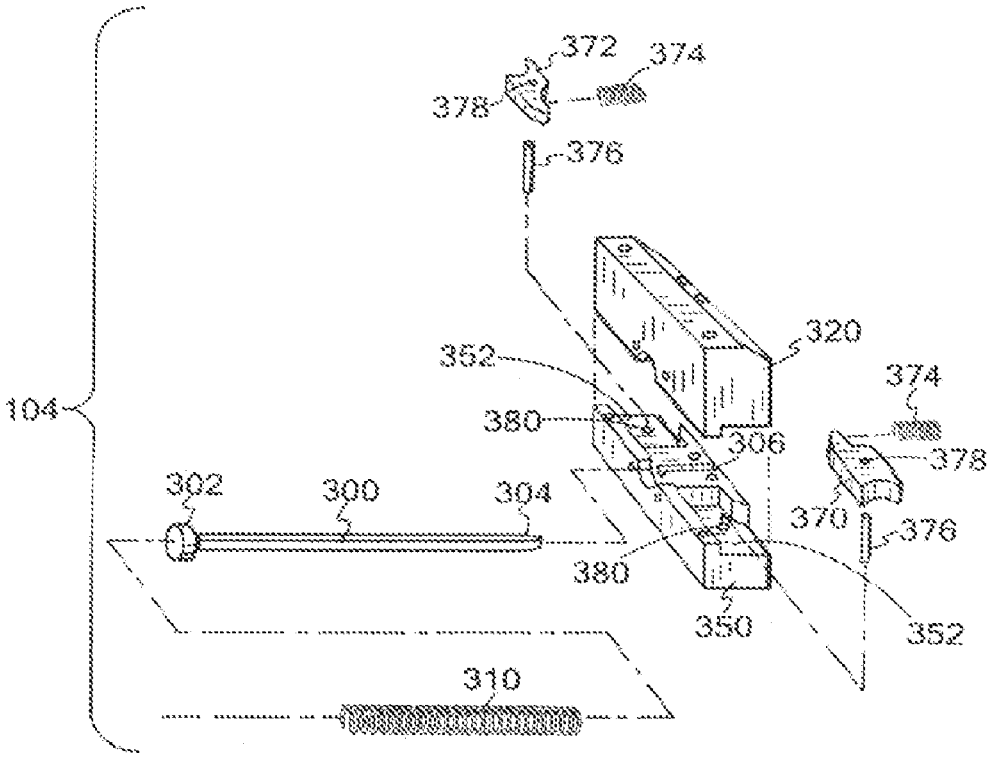
FIG. 7 depicts an exploded perspective view of plunger assembly 104 for can crushing device 100 based on FIG. 2.

Adding FIG. 5 to the consideration, a crank case assembly 106 provides the necessary function for the can crusher 100. Base cover 130 of crank case assembly 106 is spaced from the case base 132. Left case wall 134, right case wall 136, and rear case wall 138 cooperate with case base 132 to form part of a case for crank case assembly 106. Front case wall 140 completes the case for the crank case assembly 106. Front case wall 140 communicates with the plunger assembly 104 (FIG. 7).

Secured to front case wall 140 is left bracket spacer 142 and right bracket spacer 144. On left bracket spacer 142 is mounted left bracket 146. On right bracket spacer 144 is mounted right bracket 148. Between left bracket 146 and right bracket 148 is travel passage 150, through which, the plunger assembly 104 (FIG. 7) operates. A stop 152 is secured to rear case wall 138 oppositely disposed from travel passage 150. Mounted on the stop 152 is a shock absorber 154 to absorb the recoil of the plunger assembly 104.

The return spring 160 is fastened to case base 132 by fastener block 162 at one end and to the plunger assembly 104 at the other end. Return spring 160 passes through spring cavity 164 into spring tunnel 166. Pusher bar 168 for plunger assembly 104 surrounds the spring 160.

Adjacent to the pusher bar 168 is the coupling flange 170 which supports a denting rod 172 due to the action of cam 174. Cam 174 permits rod 172 to cause can crimp 176. As the withdrawal of rod 172 occurs, can 112 is crimped to a position of rod withdrawal 178, before final crushing.

A left guide track 180 and a right guide track 182 mounted on case base 132 support travel plate 188, which carries the plunger assembly 104. A bushing aperture 194 appears in a base bushing 196 in order to receive gear shaft 198. Mounted on gear shaft 198 is bar assembly 200.

At least one of cam 174 contacts bar assembly 200, in order to activate can crusher 100 and specifically plunger assembly 104. Bar assembly 200 includes action bar 202. Within action bar 202, shaft aperture 204 also receives gear shaft 198. Additionally present in action bar 202 bolt aperture 220. Roller 222 has threaded aperture 224. Roller washer 226 is positioned over bolt aperture 220 and receives roller bolt 228, as roller bolt 228 passes therethrough into bolt aperture 220 before being secured in threaded aperture 224.

After passing through shaft aperture 204, gear shaft 198 receives action gear 232 at its action gear aperture 234. Drive gear 240 meshes with action gear 232 and rotate through the action of motor shaft 242. Top washer 250 includes a washer aperture 252, concentrically aligns with action gear aperture 234 to receive gear shaft 198.

Base cover 130 includes a shaft aperture 260 to receive gear shaft 198. Offset from shaft aperture 260 in base cover 130 is drive shaft aperture 270. Drive shaft aperture 270 receives motor shaft 242 of electric motor 122 (FIG. 4).

Figure 6:
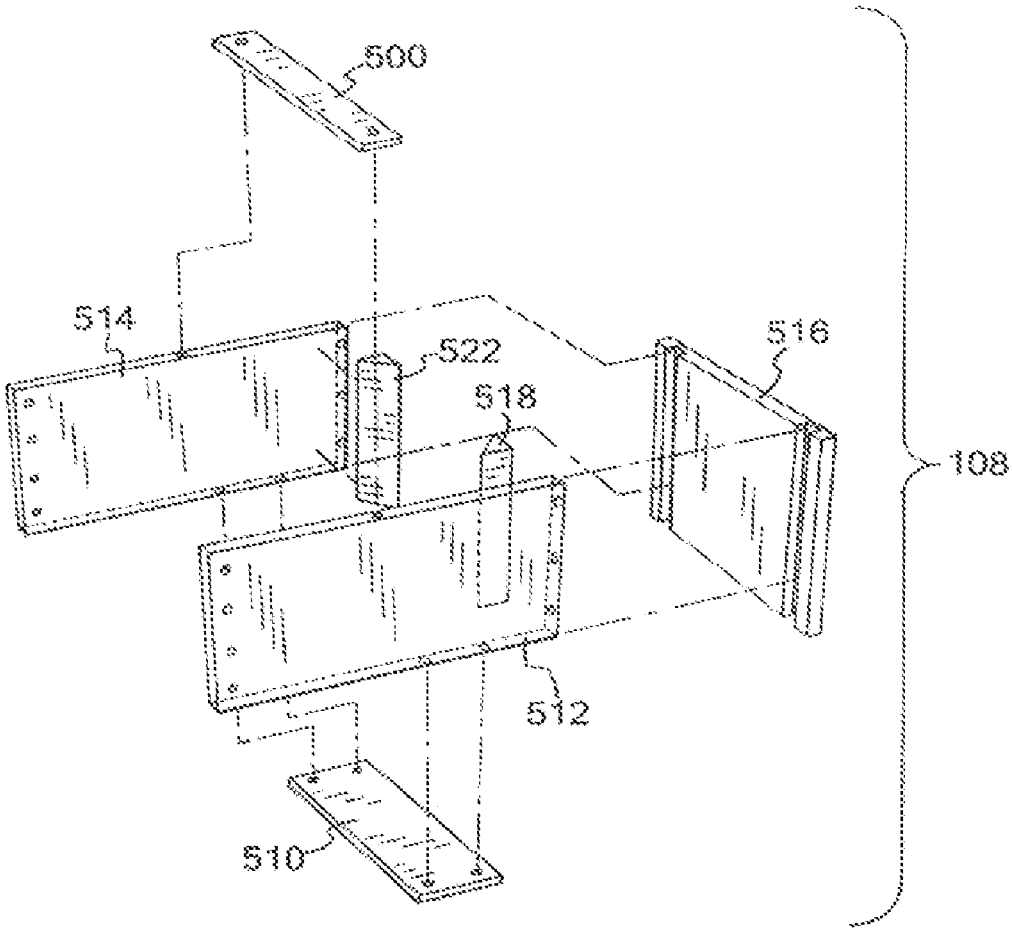
FIG. 6 depicts an exploded perspective view of crush chamber assembly 108 for can crushing device 100 based on FIG. 2.

Adding FIG. 6 to the consideration, the crush chamber assembly 108. The crush chamber assembly 108 includes a top crush cross member 500 and a bottom crush cross member 510. Top crush cross member 500 and a bottom crush cross member 510 hold left side crush panel 512 and right side crush panel 514 in a desired position relative to compound side crush panel 516 completes the crush chamber assembly 108. Additionally, first right triangle brace 518 and second right triangle brace 522 may be used as an additional support for left side crush panel 512 and right side crush panel 514 in relation to compound side crush panel 516, if desired.

Further considering FIG. 7, the structure of plunger assembly 104 is clarified. Plunger assembly 104 includes a denting rod 172 having a spring seat 302 at one end thereof and spear end 304 at the other and opposing end thereof. Spear end 304 fits into travel slot 306, while spring seat 302 receives crush spring 310 to rest thereon. Top plate 320 fits over denting rod 300 while bottom plate 350 fits under the denting rod 300.

A finger cavity 352 is on each side of travel slot 306 in bottom plate 350. A left finger 370 proceeds from one finger cavity 352 while a right finger 372 proceeds from the other finger cavity 352. A finger spring 374 rests on a pin shaft 376, which in turn rests in pin aperture 378 of left finger 370 or right finger 372. Pin shaft 376 is also received at its opposing end by shaft aperture 380.

Figure 8:
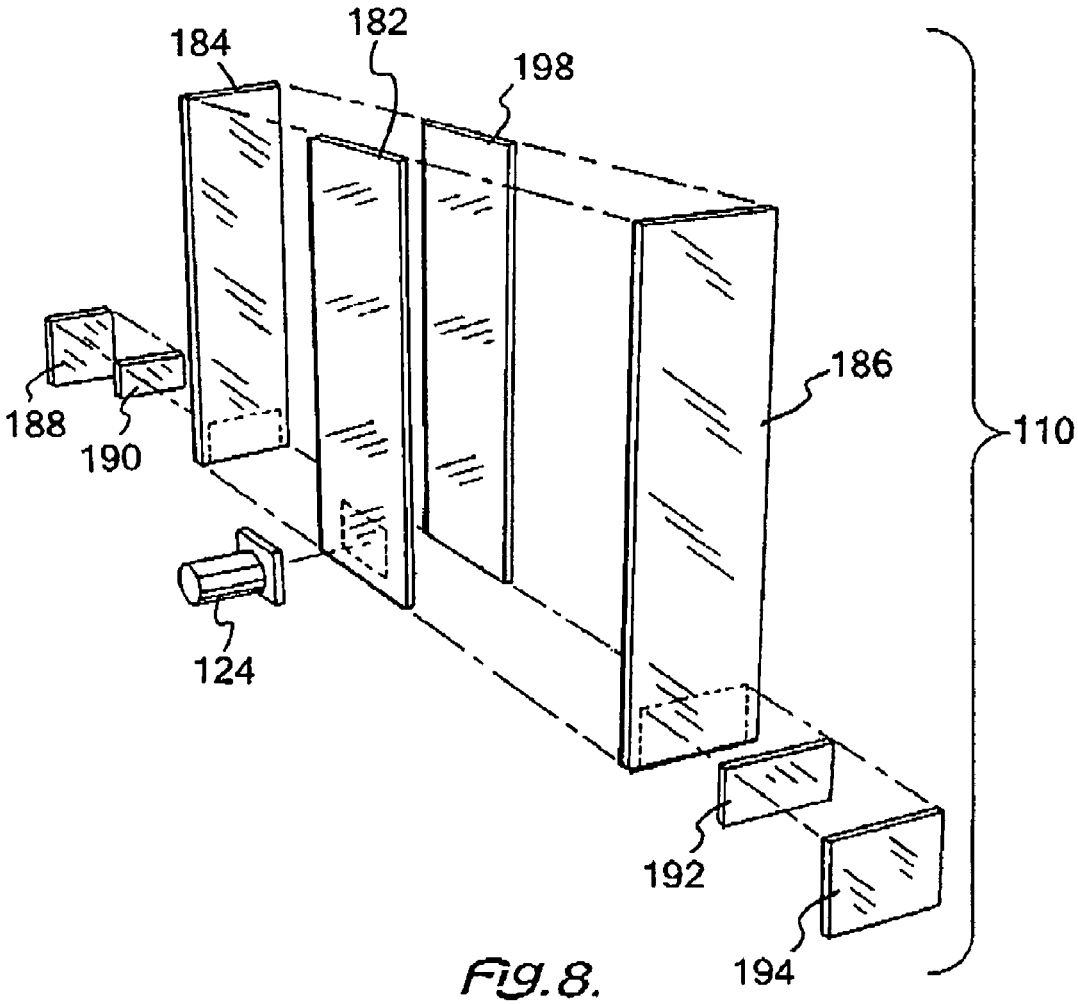
FIG. 8 depicts an exploded perspective view of feed hopper assembly 110 for can crushing device 100 based on FIG. 2.

Now including FIG. 8, the structure of feed hopper assembly 110 communicates with FIG. 6 and the crush chamber assembly 108, shows a motion switch 124 cooperating therewith. Front hopper wall 198 is oppositely disposed from rear hopper wall 182. Motion switch 124 is mounted in rear hopper wall 182. When a can 112 is adjacent motion switch 124, the electric motor 122 is activated to form can 112 into crushed can 114.

Right hopper wall 184 and left hopper wall 186 are oppositely disposed from each other and complete part of the feed hopper assembly 110. Right bracket 188 secures right hopper wall 184 to right side crush panel 514 (FIG. 6), with right spacer 190 therebetween. Left bracket 194 secures left hopper wall 186 to left side crush panel 512 (FIG. 6), left spacer 192 therebetween. In this fashion feed hopper assembly 110 communicates with crush chamber assembly 108.

Figure 9:
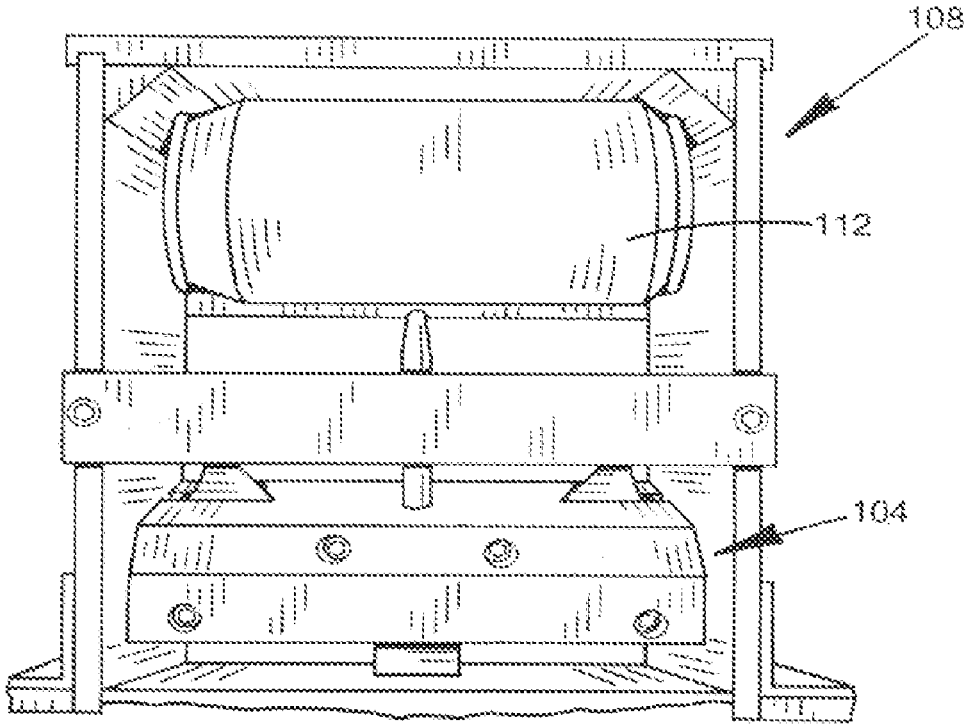
FIG. 9 depicts a top view of crush chamber assembly 108 for can crushing device 100 operating on can 112 based on FIG. 2.
Figure 10:
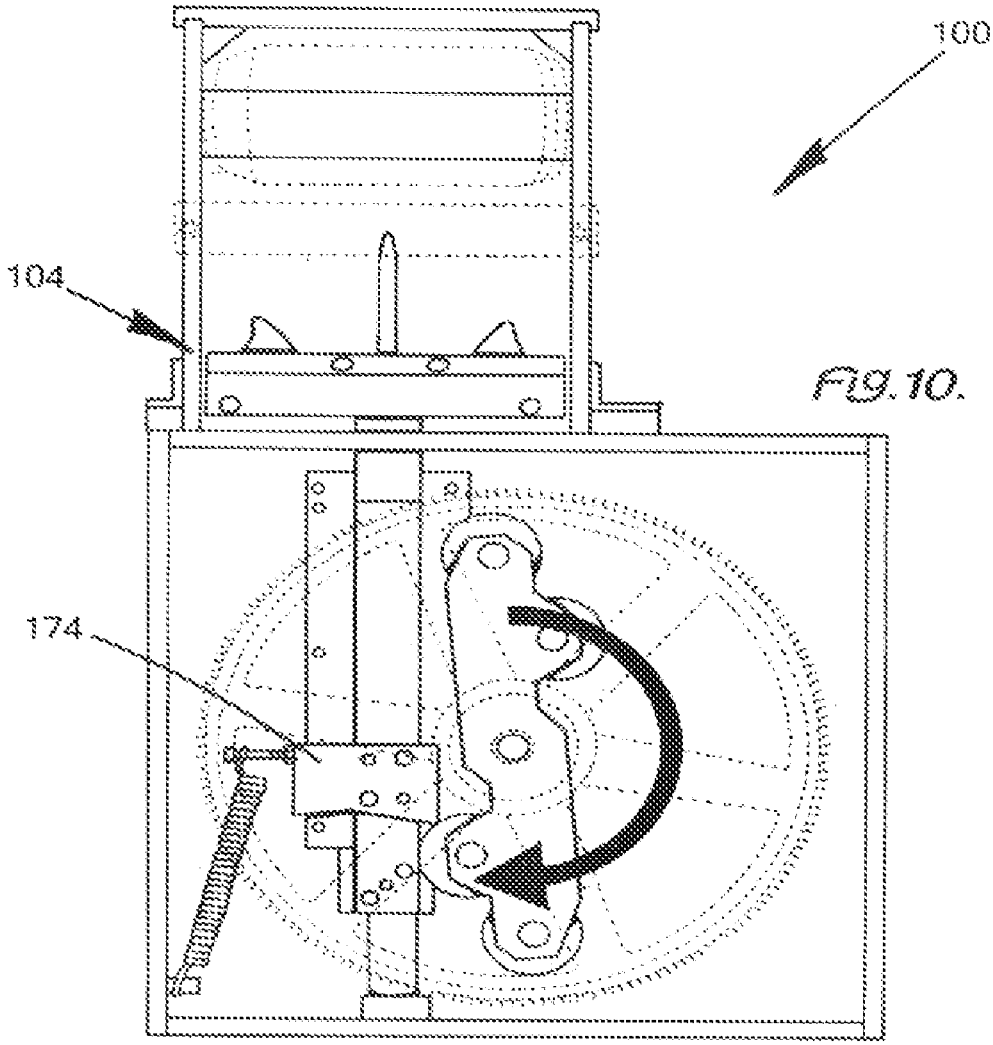
FIG. 10 depicts a top view of crush chamber assembly 108 for can crushing device 100 operating on can 112 with crankcase assembly 106.
Figure 11:
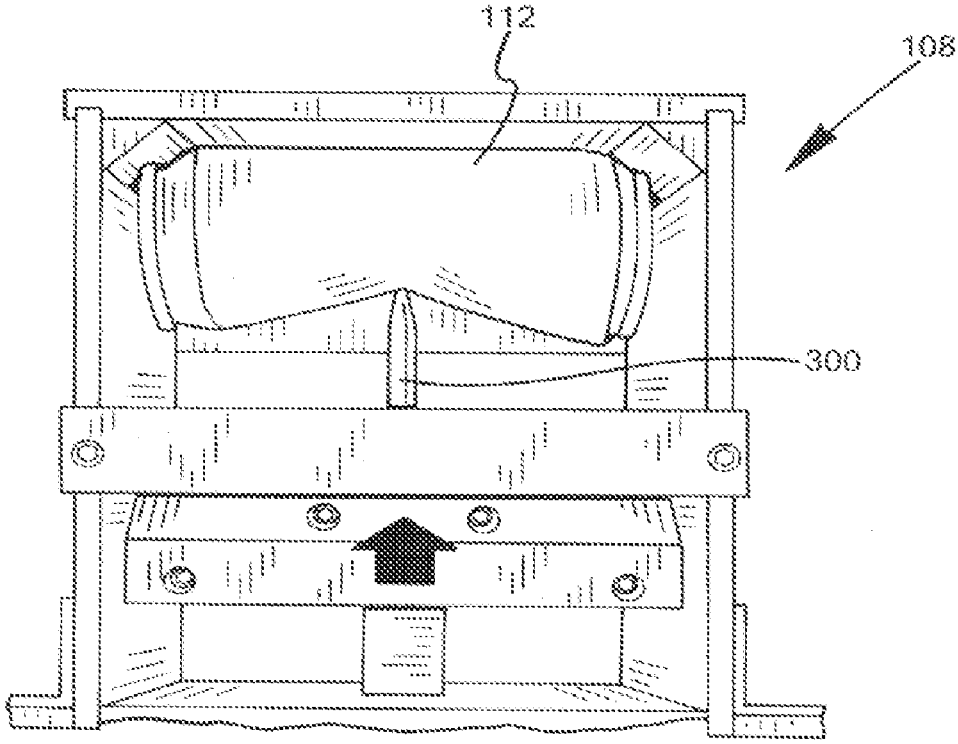
FIG. 11 depicts a top view of crush chamber assembly 108 for can crushing device 100 operating on can 112 for middle crush 126.
Figure 12:
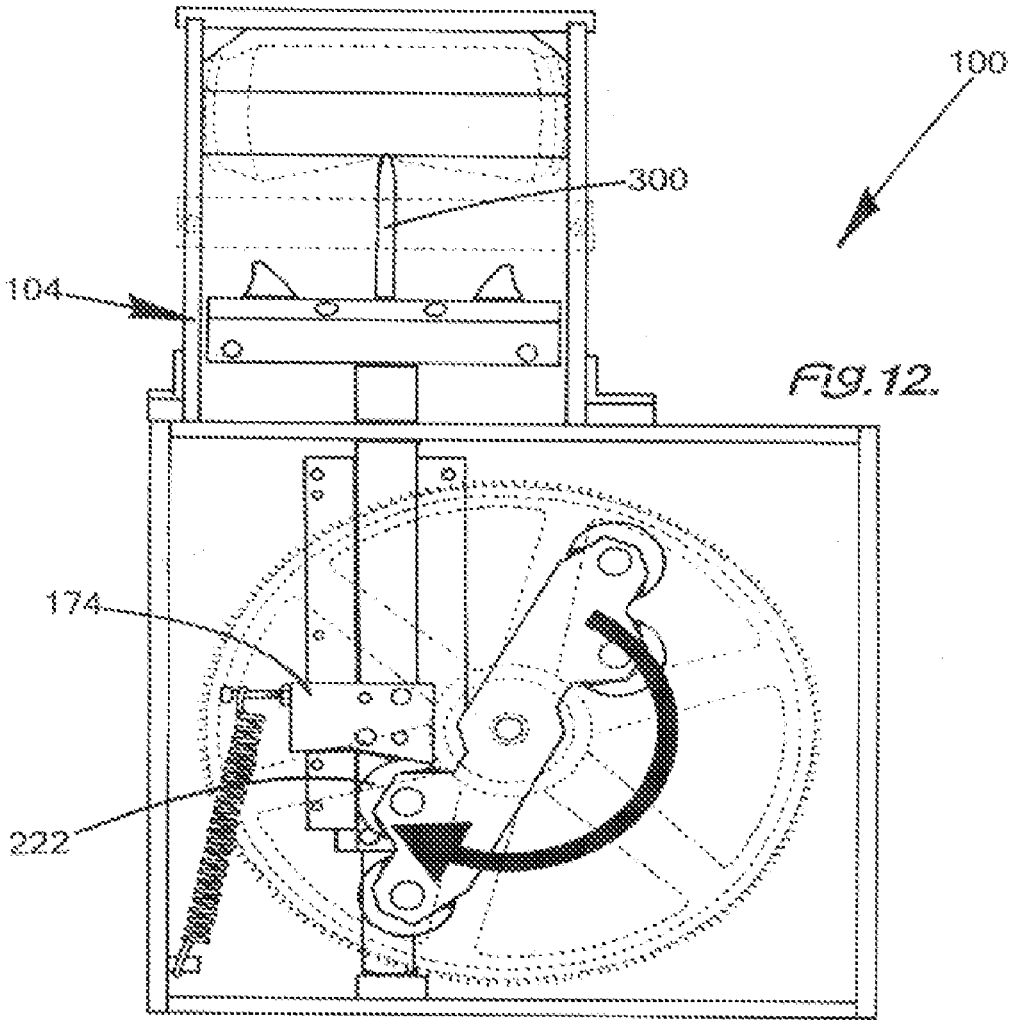
FIG. 12 depicts a top view of crush chamber assembly 108 for can crushing device 100 operating on can 112 with crankcase assembly 106 for middle crush 126.
Figure 20:
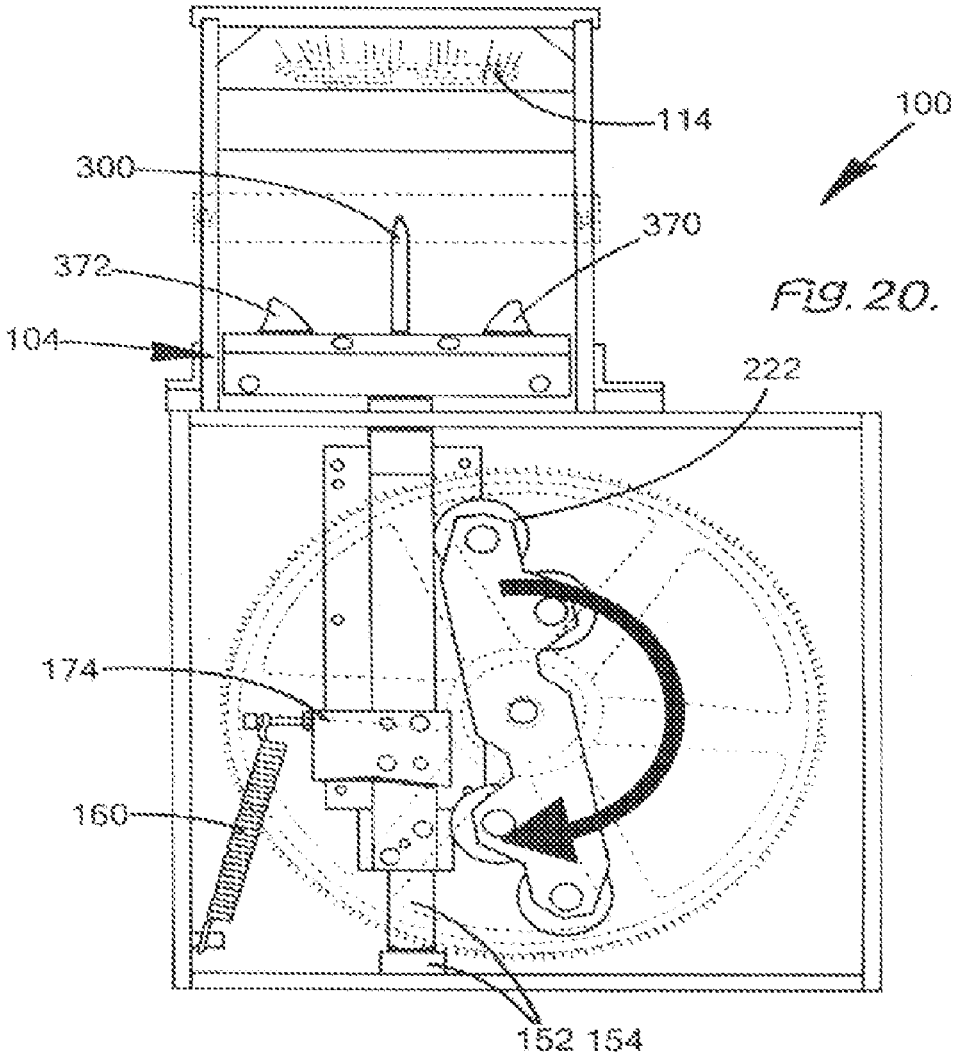
FIG. 20 depicts a top view of crush chamber assembly 108 for can crushing device 100 operating on can 112 with crankcase assembly 106 for rod withdrawal 178.

FIG. 9, FIG. 10, FIG. 11, FIG. 12, FIG. 13, FIG. 14, FIG. 15, FIG. 16, FIG. 17, FIG. 18, FIG, 19, and FIG. 20 cooperate to show the crushing of can 112. FIG. 9 and FIG. 10 show the can 112 in the crush chamber assembly 108 prior to any crushing action. FIG. 11 and FIG. 12 show the can 112 in the crush chamber assembly 108 as denting rod 300 contacts the can 112 to create a dent therein along with the appropriate position for cam 174 and roller 222.

Figure 13:
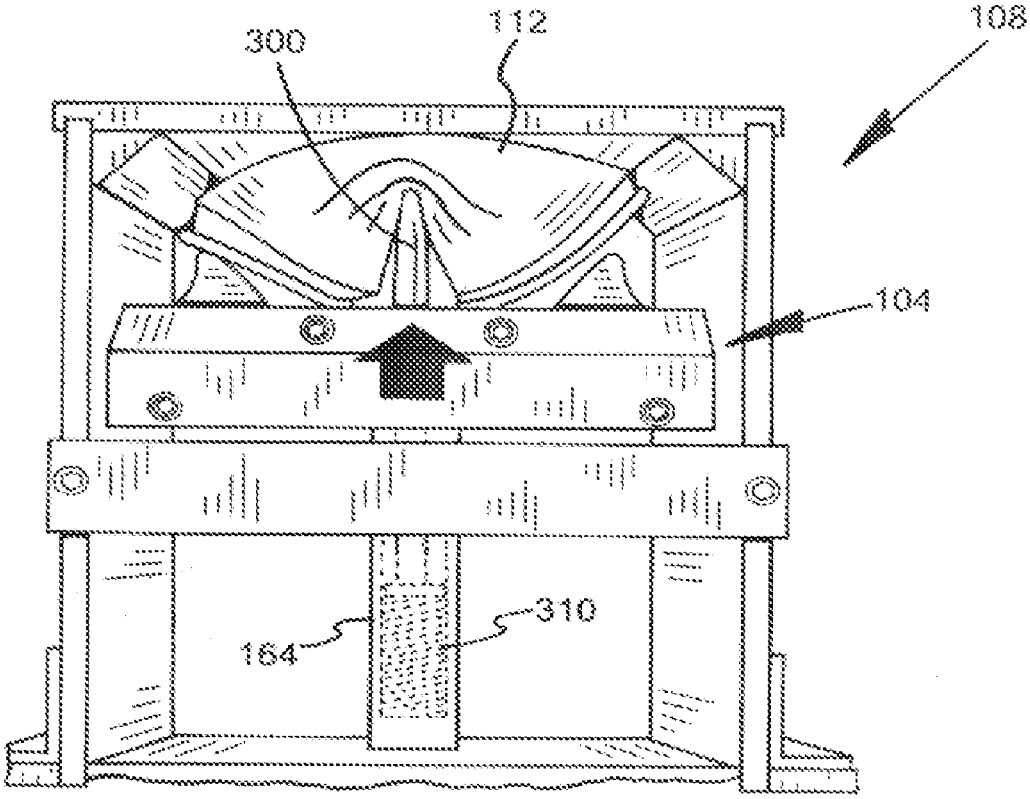
FIG. 13 depicts a top view of crush chamber assembly 108 for can crushing device 100 operating on can 112 for rod crush 128.
Figure 14:
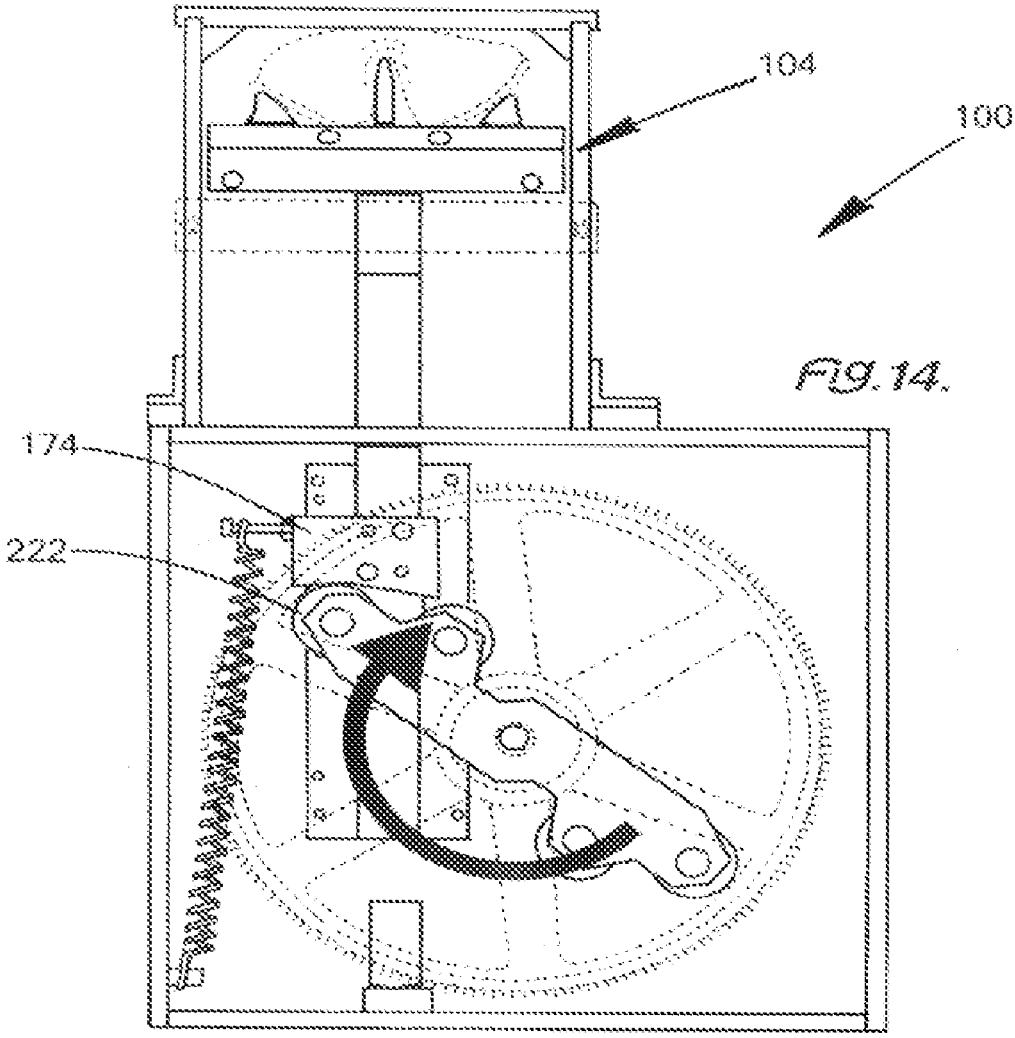
FIG. 14 depicts a top view of crush chamber assembly 108 for can crushing device 100 operating on can 112 with crankcase assembly 106 for rod crush 128.

FIG. 13 and FIG. 14 show the can 112 in the crush chamber assembly 108 as denting rod 300 further contacts the can 112 to increase the dent therein along with the appropriate position for cam 174 and roller 222. Right finger 370 and left finger 372 contact can 112 to continue the crushing process. Denting rod 300 begins to retract from the can 112.

Figure 15:
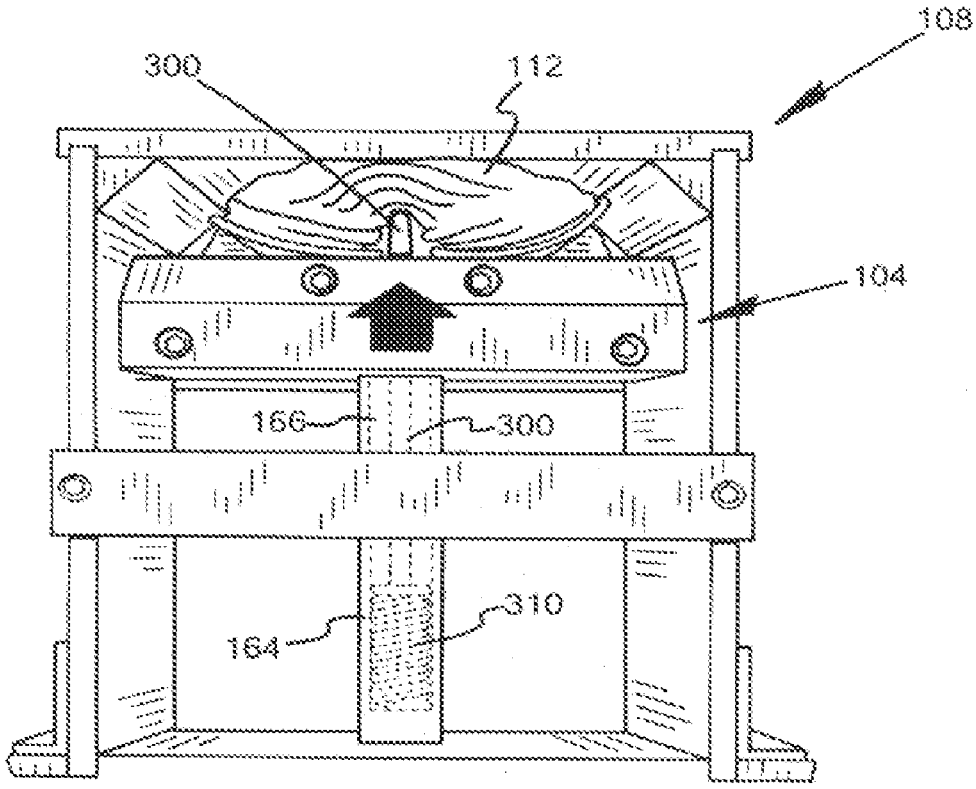
FIG. 15 depicts a top view of crush chamber assembly 108 for can crushing device 100 operating on can 112 for rod withdrawal 172.
Figure 16:
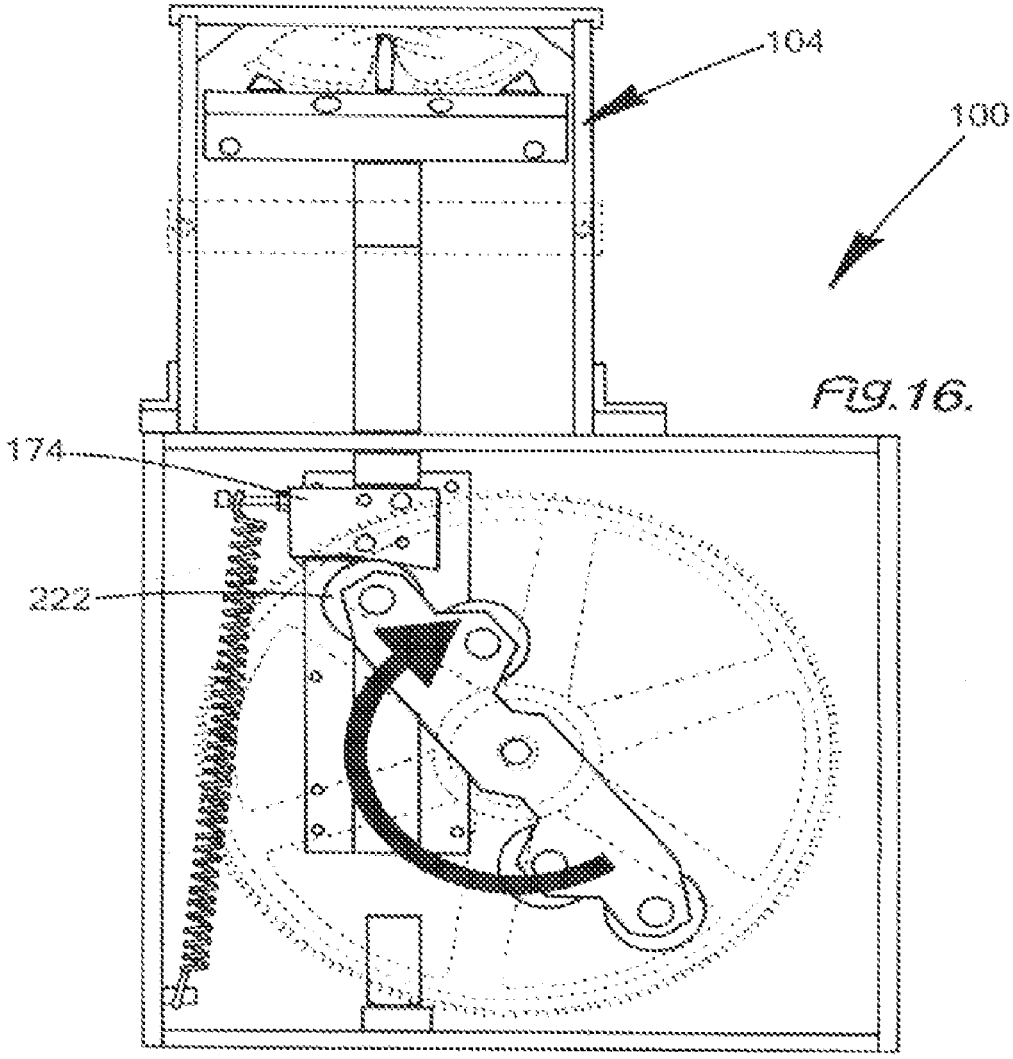
FIG. 16 depicts a top view of crush chamber assembly 108 for can crushing device 100 operating on can 112 with crankcase assembly 106 for rod withdrawal 172.

FIG. 15 and FIG. 16 show the can 112 in the crush chamber assembly 108 along with the appropriate position for cam 174 and roller 222. Right finger 370 and left finger 372 contact can 112 to complete the crushing process. Denting rod 300 continues to retract from the can 112.

Figure 17:
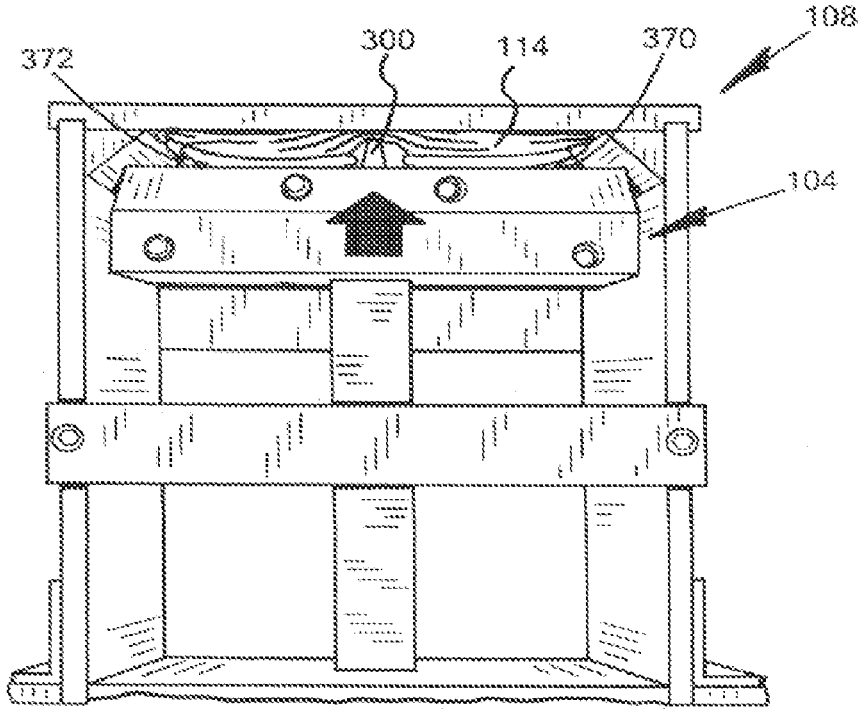
FIG. 17 depicts a top view of crush chamber assembly 108 for can crushing device 100 operating on can 112 for can crimp 176.
Figure 18:
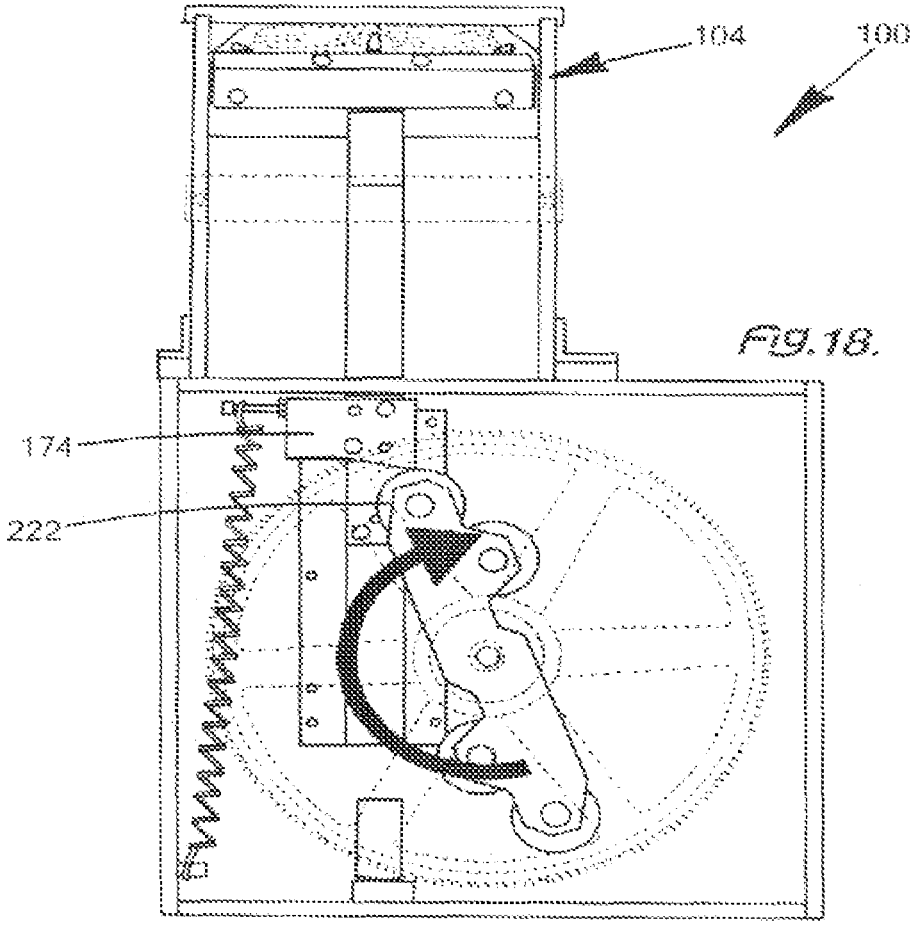
FIG. 18 depicts a top view on crush chamber assembly 108 for can crushing device 100 operating on can 112 with crankcase assembly 106 for can crimp 176.

FIG. 17 and FIG. 18 show the can 112 as completely crushed can 114 in the crush chamber assembly 108 along with the appropriate position for cam 174 and roller 222. Right finger 370 and left finger 372 retract from can 112 as plunger assembly 104 completes the crushing process. Denting rod 300 is completely retracted from any contact with the can 112.

Figure 19:
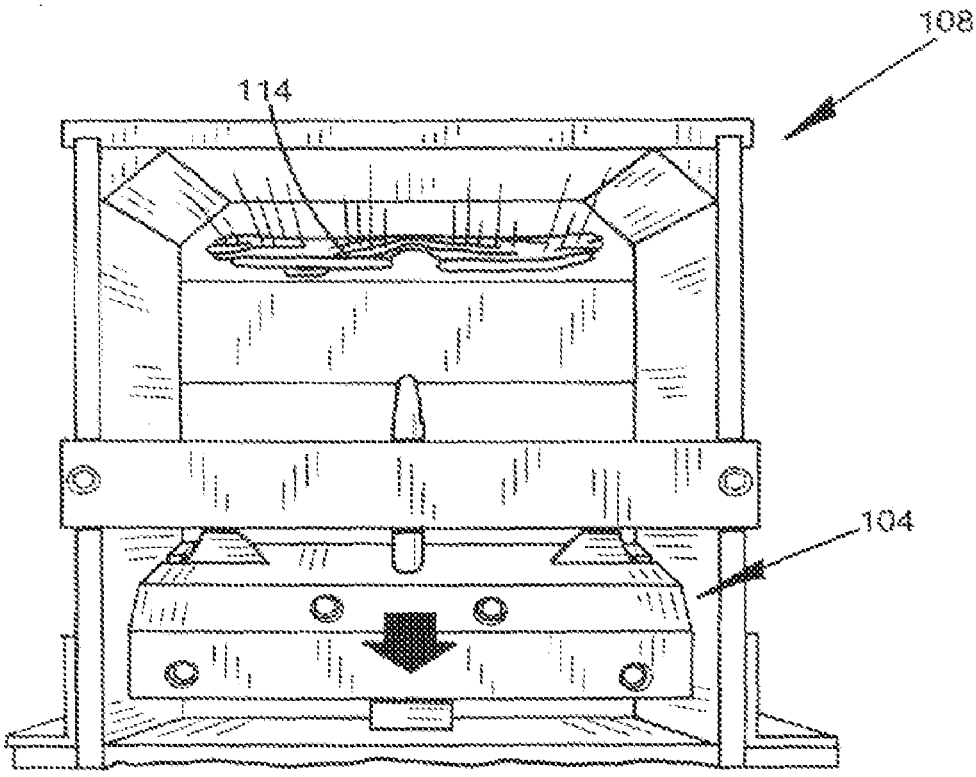
FIG. 19 depicts a top view of crush chamber assembly 108 for can crushing device 100 operating on can 112 for rod withdrawal 178.

FIG 19 and FIG. 20 show the can 112 as completely crushed can 114 in the crush chamber assembly 108 along with the appropriate position for cam 174 and roller 222. Right finger 370 and left finger 372 retract from can 112 as plunger assembly 104 withdraws from the can 112. Crushed can 114 then drops into crush can container 102, for any desired further processing. More specifically, roller 222 slips off of cam 174 and releases plunger assembly 104 back to shock absorber 152 and stop 154.

Figure 21:
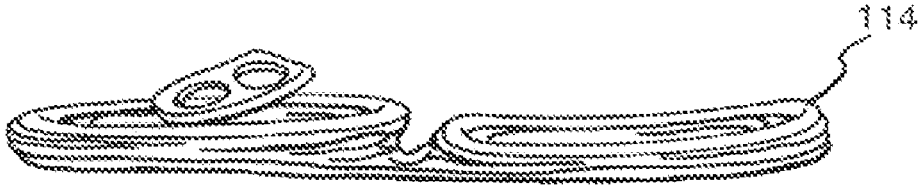
FIG. 21 shows beverage can 112 reduced to crushed can 114.

FIG. 21 depicts a final product of the crushed can 114. With crushed can 114 having this shape, further transportation or use of the crushed can 114. Baling or container transportation is very possible.

Figure 22:
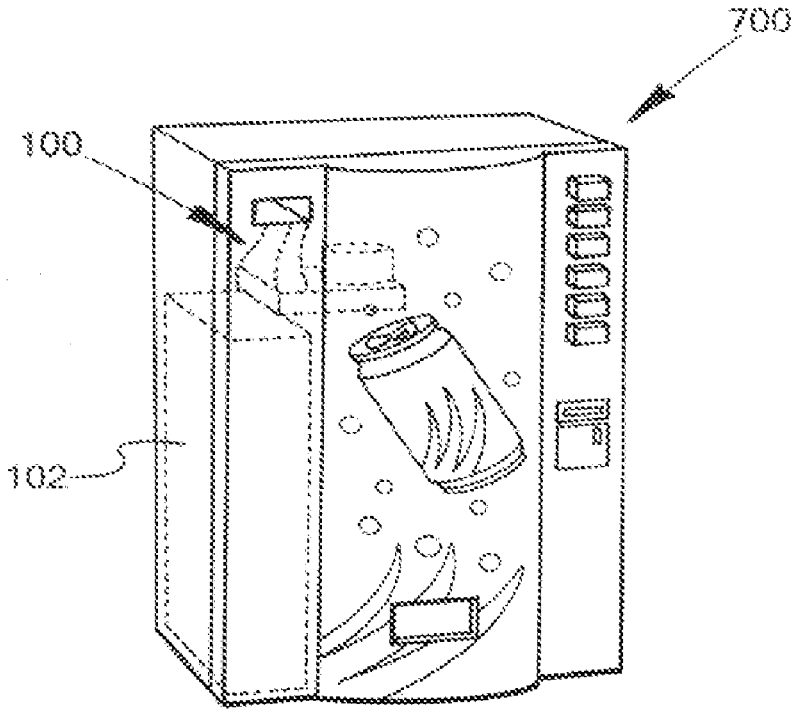
FIG. 22 depicts can crushing device 100 mounted with a soft drink machine 700.

FIG. 22, FIG. 23, FIG. 24 and FIG. 25 combine to depict can crushing device 100 in some if the variety of uses therefor. FIG. 22 shows can crushing device 100 mounted with a soft drink machine 700 with container 102. Such a strategic location greatly facilitates the use thereof, thereby improving recycling opportunities.

Figure 23:
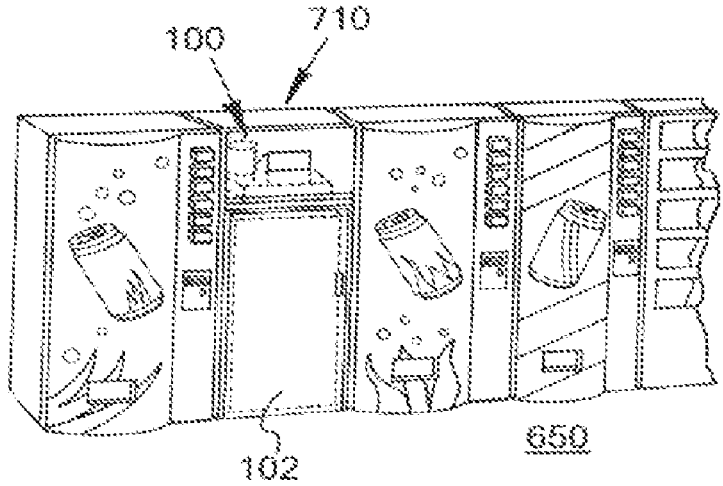
FIG. 23 depicts can crushing device 100 as free standing unit 710.

With FIG. 23 depicting can crushing device 100 with container 102 as free standing unit 710 in a lunchroom 650, it becomes clear that portable versions thereof may be transported to a desired position. With can crushing device 100 so conveniently located, more efficient use thereof is achieved. Can crushing device 100 may be located at a site where beverages in aluminum cans are being consumed. Such convenience makes it more like that can crushing device 100 will be used.

Figure 24:
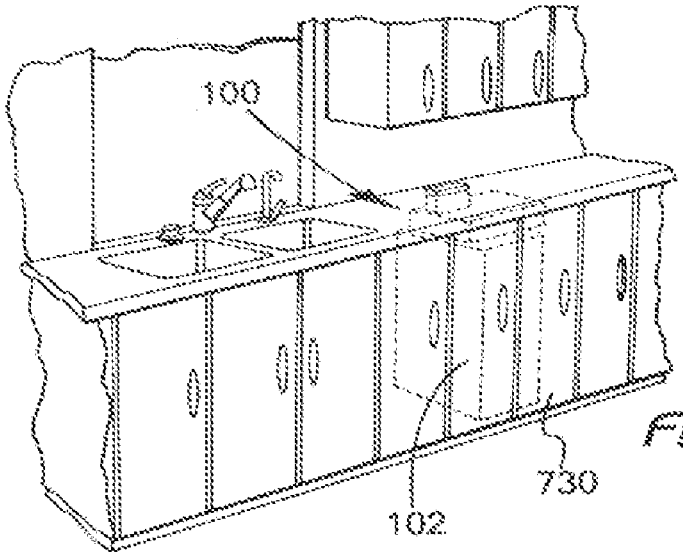
FIG. 24 depicts can crushing device 100 mounted in a kitchen cabinet 730.
Figure 25:
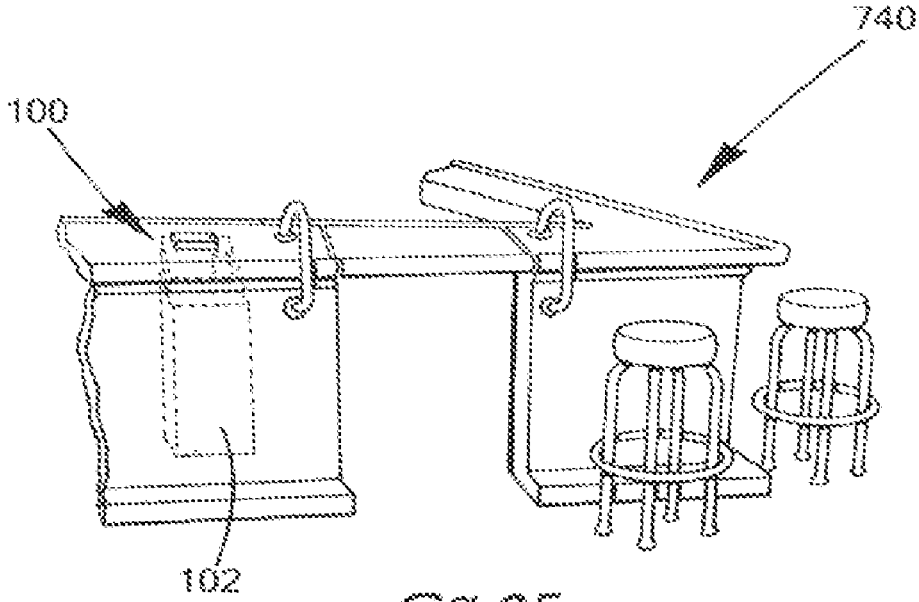
FIG. 25 depicts can crushing device 100 mounted in a commercial bar 740.

Whether can crushing device 100 with container 102 is mounted in a kitchen cabinet 730 as in FIG. 24 in a commercial bar 740 as in FIG. 25, time, space and efficiency are maximized. With crushing device 100 so convenient, space is saved for crushed cans 114, and permit either area to have more efficient use.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Becausse of this disclosure and solely because of this disclosure, modification of this device can become clear to a person having ordinary skill in this particular art. Such modifications are clearly covered by this disclosure.

What is claimed and sought to be protected by Letters Patent is:

1. A can crushing device for flattening a can along a cylindrical axis of the can, the can crushing device comprising:

a) a crushing assembly, a feed hopper assembly and a crush chamber assembly;

b) the crush chamber assembly including a crushing chamber and a can platform adapted to support the can in the crushing chamber as the can is being crushed;

c) the feed hopper assembly communicating with the can platform in order to convey the can to be crushed thereto;

d) the crushing assembly communicating with the can platform and the crushing chamber in order to flatten the can along a cylindrical axis of the can, the crushing assembly including a crankshaft assembly and a plunger assembly;

e) a ram of the plunger assembly is configured to slide over the can platform;

f) the ram being extendible into the crushing chamber to flatten the can against a compound side crush panel of the crushing chamber;

g) the ram including a denting rod extendible therefrom;

h) the rod being adapted to make a dent in a side of the can;

i) the ram and the rod cooperating to flatten the can along the cylindrical axis, thereby providing for a top and a bottom of the can to be on a game side of the can as crushed;

j) the crushed can being adaptable to form a bale for transport;

k) a left finger pivotally mounted in a first finger cavity located on one side of the ram and a right finger pivotally mounted in a second finger cavity located on the other side of the ram, the fingers cooperating with the ram and the rod to contact and flatten the can along the cylindrical axis l) the crankcase assembly connecting to the plunger assembly in order to direct the plunger assembly into and out of the crush chamber assembly;

m) a means to sense a presence of the can serving to activate the plunger assembly;

n) the crankcase assembly being connected to a gear box;

o) the gear box being powered by an electric motor to activate the plunger assembly;

p) the feed hopper assembly including a motion switch to activate the electric motor through electric circuit;
q) the crank case assembly including a base cover, a case base, a left case wall, a right case wall, front case wall and a rear case wall;
r) the base cover being spaced from the case base, by the left case wall and the right case wall;
s) the right case wall and the left case wall separating the front case wall and the rear case wall;
t) the front case wall communicating with the plunger assembly;
u) the front case wall including a left bracket spacer and a right bracket spacer;
v) the left bracket spacer having left bracket mounted thereon;
w) the right bracket spacer having right bracket mounted thereon;
x) a travel passage through which the plunger assembly reciprocally passes being situation between the left bracket and the right bracket, the travel passage is formed in the front case wall;
y) a stop being secured to the rear case wall and oppositely disposed from travel passage; and
z) the stop having a shock absorber to absorb a recoil of the plunger assembly.

2. The can crushing device of claim 1 further comprising:
a) a return spring being fastened to the case base by a fastener block at a first end thereof;
b) the return spring being fastened to the plunger assembly at a second and opposing end thereof;
c) the return spring passing through a spring cavity into a spring tunnel; and
d) a pusher bar for the plunger assembly surrounding the return spring.

3. The can crushing device of claim 2 further comprising:
a) a coupling flange being positioned adjacent to the pusher bar;
b) the coupling flange supporting the denting rod;
c) the gear box operating at least one cam; and
d) the cam causing the denting rod and the plunger assembly to sequentially contact and crush the can.

4. The can crushing device of claim 3 further comprising:
a) a left guide track and a right guide track being mounted on case base to support a travel plate;
b) the travel plate carrying the plunger assembly;
c) a bushing aperture appearing in a base bushing in order to receive a gear shaft;
d) a gear shaft being mounted on the bar assembly; and
e) the at least one of cam contacting the bar assembly in order to activate the plunger assembly.

5. The can crushing device of claim 2 further comprising:
a) a bar assembly including an action bar;
b) the action bar including a shaft aperture to receive a gear shaft;
c) the action bar further including a bolt aperture;
d) a roller having a threaded roller aperture;
e) a roller washer being positioned over the bolt aperture to receive a roller bolt;
f) the roller bolt passing through the roller washer into the bolt aperture; and
g) the roller bolt then being secured in the threaded roller aperture.

6. The can crushing device of claim 5 further comprising:
a) the gear shaft passing through the shaft aperture;
b) the gear shaft then receiving an action gear at its action gear aperture;
c) a drive gear meshing with the action gear and rotating through the action of a motor shaft of the electric motor;
d) a top washer concentrically aligning with the action gear aperture to receive the gear shaft; and
e) the base cover including a gear shaft aperture to receive the gear shaft.

7. The can crushing device of claim 6 further comprising:
a) the gear shaft passing through the gear shaft aperture;
b) the base cover further including a drive shaft aperture;
c) the gear shaft aperture being offset from the drive shaft aperture; and
d) the drive shaft aperture receiving the motor shaft of the electric motor.

8. The can crushing device of claim 7 further comprising:
a) the crush chamber assembly including a top crush cross member, a bottom crush cross member, a left side crush panel, a right side crush panel and the compound side crush panel;
b) the top crush cross member and the bottom crush cross member holding the left side crush panel and the right side crush panel in a desired position relative to the compound side crush panel to complete the crush chamber assembly;
c) a first right triangle brace supporting the left side crush panel relative to the compound side crush panel; and
d) a second right triangle brace supporting the right side crush panel relative to the compound side crush panel.

9. The can crushing device of claim 8 further comprising:
a) the plunger assembly including the denting rod having a spring seat at a first end thereof and a spear end at a second end and opposing end thereof;
b) the spear end fitting into a travel slot;
c) the spring seat resting on a crush spring;
d) a top plate fitting over the denting rod;
e) a bottom plate fitting under the denting rod;
f) the first finger cavity being positioned on a first side of the travel slot in the bottom plate;
g) the second finger cavity being positioned on a second side of the travel slot in the bottom plate;
h) the left finger proceeding from the first finger cavity;
i) the fright finger proceeding from the second finger cavity.

10. The can crushing device of claim 9 further comprising:
a) the feed hopper assembly including a front hopper wall oppositely disposed from a rear hopper wall and a left hopper wall oppositely disposed from a right hopper wall;
b) the motion switch being mounted in the rear hopper wall;
c) the rear hopper wall being adjacent to an electric circuit box;
d) a right bracket securing the right hopper wall to the right side crush panel, with a right spacer therebetween;
e) a left bracket securing the left hopper wall to the left side crush panel, with a left spacer therebetween; and
f) the feed hopper assembly communicating with the crush chamber assembly.

* * * * *